United States Patent [19]

Headen et al.

[11] 4,121,773

[45] Oct. 24, 1978

[54] SHOWER HEAD DISPENSER

[76] Inventors: James J. Headen, 1337 Juniper Lane, Lewisville, Tex. 75067; Reginald H. Fowler, 2113 Milpond, Garland, Tex. 75242

[21] Appl. No.: 781,773

[22] Filed: Mar. 28, 1977

[51] Int. Cl.[2] ..... B05B 7/30

[52] U.S. Cl. ..... 239/317; 239/318; 239/365

[58] Field of Search ..... 239/310, 317, 318, 364–367

[56] References Cited

U.S. PATENT DOCUMENTS

| | | | |
|---|---|---|---|
| 2,058,901 | 10/1936 | McPherson | 239/310 X |
| 2,235,278 | 3/1941 | Brunner | 239/318 X |
| 3,132,806 | 5/1964 | McNair et al. | 239/366 X |
| 3,194,444 | 7/1965 | Hubert | 239/310 X |
| 3,764,074 | 10/1973 | James | 239/318 |
| 3,847,354 | 11/1974 | Lemond | 239/318 X |

*Primary Examiner*—Robert W. Saifer

*Attorney, Agent, or Firm*—Thomas L. Cantrell; Joseph H. Schley

[57] ABSTRACT

Disclosed is a shower head dispenser for bath oil and the like which includes a body member with an axial bore adapted for insertion between a shower line and a shower head. The body member has two longitudinally spaced apertures in its side wall which communicate between the bore and a detachable oil container. A plug is rotatably mounted in the bore of the body. It has an axial venturi bore therethrough, and a pair of transverse bores, one of which intercepts the axial bore at the venturi throat, and the other of which intercepts the axial bore upstream of the throat. The transverse bores of the plug are registrable with the apertures of the body upon rotation of the plug. When water passes through the venturi bore of the plug with the transverse bores aligned with the apertures, the greater pressure at the upstream bore and aperture forces oil out of the container through the downstream bore and aperture into the venturi throat, where it mixes with water enroute to the shower head.

1 Claim, 4 Drawing Figures

SHOWER HEAD DISPENSER

BACKGROUND OF THE INVENTION

Bath oil and similar skin conditioners are water soluble or water dispersible materials of fairly high viscosity which have been traditionally added in small quantities to bath water. It has been proposed in the past to mix bath oil with water passing through a shower head by aspirating it into the shower line at a point upstream of the head. Such systems have not found wide acceptance because they are extremely sensitive to water flow rate, since they rely on the differential between atmospheric pressure and the pressure of the flowing water at the point of aspiration, and this differential is quite small at low flow rates. In addition, the line constriction required to produce good aspiration objectionably limits the maximum delivery rate of the shower line. Furthermore, the small lines involved in aspiration systems are prone to clogging.

SUMMARY OF THE INVENTION

In accordance with the present invention, a positive displacement system is provided for introducing bath oil into a shower line just upstream of the shower head. Although the invention is primarily intended for use with bath oil, shampoo, soap, rinses, and the like may also be dispensed by it. The bath oil, etc., is preferably a liquid, but may be a gel or solid. The dispenser of the invention introduces oil into the water flowing through the shower line reliably, substantially independently of flow rate or low line pressure. The passages through which the oil flows in the device are of substantial diameter, and are not prone to clogging. In addition, the device is self-flushing after use, and may be flushed in several manners to prevent oil build-up leading to clogging.

The dispenser of the invention, in its preferred form, includes a body member having an axial bore therethrough. The body member is adapted to be inserted between a shower line and shower head, and is provided with threaded end portions for this purpose. In a side wall of the body member, preferably at the bottom of the member as it is oriented in ordinary installation, are provided two longitudinally spaced apertures, which may conveniently be designated "upstream" and "downstream" by reference to their relative positions on the body member. The apertures, in addition to being spaced, are preferably aligned with each other longitudinally, that is, parallel to the axis of the axial bore. These apertures provide communication between the axial bore and the exterior of the body member.

On the outside of the body member, the apertures are surrounded or encircled by fitting means, such as a threaded socket. A detachable oil container, with mating attachment means, such as a threaded neck or rim, is adapted for connection to the body member at the fitting means. Preferably the oil container is sized to accommodate sufficient bath oil for a single application.

A cylindrical plug is mounted for rotation within the axial bore of the body member. The plug has an axial venturi bore passing therethrough which is sized and shaped to create the desired pressure conditions (discussed below) in the water flowing through the unit, while at the same time permitting water delivery rates to the shower head which are satisfactory.

The plug is also provided with a pair of transverse bores, one of which intercepts the venturi bore at the throat of the venturi, and the other of which intercepts the venturi bore at a selected point upstream of the throat. The transverse bores of the plug are so positioned that they may be brought into and out of registry with the beforementioned apertures of the body member upon rotation of the plug within the body. The bore positioned at the venturi throat registers with the downstream aperture, and the upstream bore registers with the upstream aperture.

Means are provided for rotating the plug at will to activate and deactivate the dispenser. In the preferred form of the invention, these comprise a circumferential slot in the wall of the body member on the side thereof opposite the apertures, i.e., on the top side. A button is provided with a pin extending through the slot to engage the plug. Movement of the button back and forth in the slot effects the desired rotation of the plug.

In use, the oil container is first filled with a suitable amount of bath oil, and attached to the body member. At the point in a shower when it is desired to apply bath oil, the button is actuated to bring the transverse bores of the plug into alignment or registry with the apertures of the body. The water pressure in the venturi bore at the point of interception of the upstream transverse bore is always greater than the water pressure at the venturi throat, where the downstream transverse bore intercepts the venturi bore. This is the case, no matter what the flow rate or absolute water pressure. As a consequence, water flows through the upstream bore and aperture into the oil container, where it picks up oil (or forces oil ahead of it) and flows through the downstream aperture and bore to rejoin the main stream of water at the venturi throat. The oil-water mixture then flows through the shower head. This action continues until the oil supply is exhausted, or the button is actuated to turn the dispenser off.

From the foregoing it can be seen that a principal object of the present invention is the provision of an improved shower head bath oil dispenser which creates pressure conditions in the flowing water which are exploited to positively displace the oil into the water stream.

Other objects of the invention include the provision of a shower head dispenser which is easy to use, simple in construction, and safe and reliable in operation.

The manner in which the foregoing objects and purposes, together with other objects and purposes, are attained may best be understood from a consideration of the detailed description which follows, together with the accompanying drawings.

DESCRIPTION OF THE PREFERRED EMBODIMENTS

Figure 1:
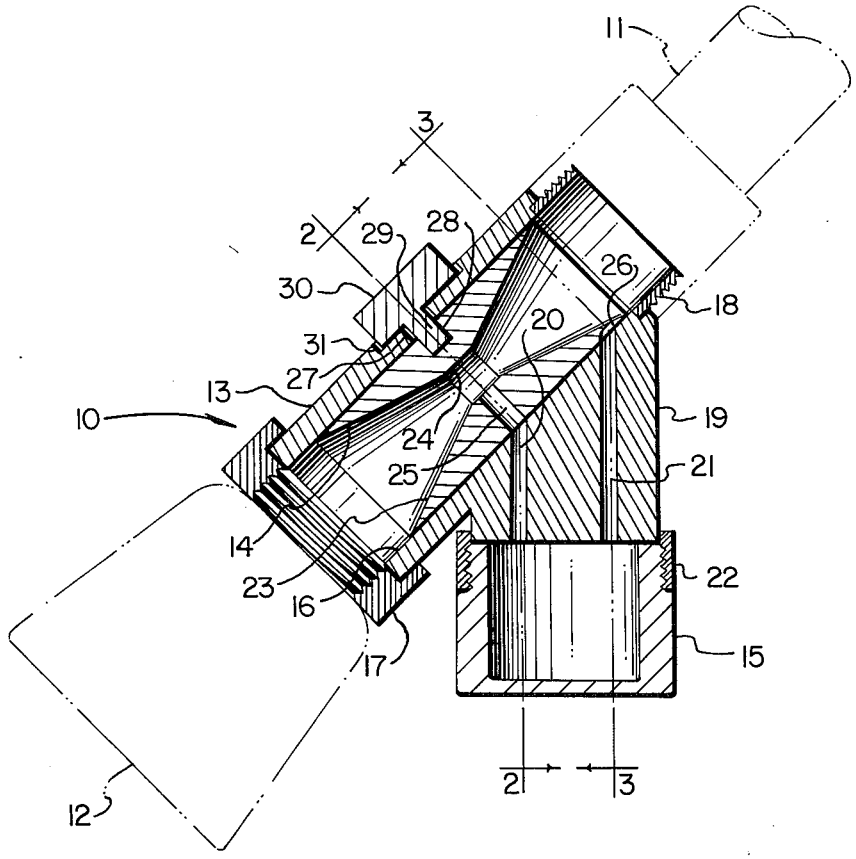
FIG. 1 is a cross-sectional side elevational view of a shower head dispenser constructed in accordance with the invention.

In the drawings, the shower head bath oil dispenser of the invention is designated generally as 10. It is adapted for insertion into a shower line, and is thus shown in FIG. 1 as interposed between shower line pipe 11 and shower head 12. The dispenser 10 may be executed in plastic, metal, or partly in each, or made from any other suitable material. It is shown in FIG. 1 oriented approximately in its installed and in-use position, and references to "top" and "bottom" are made herein with relation to this position. As FIG. 1 is drawn, the flow of water through the device is from right to left, and in this description references are occasionally made to the relative location of parts of the device as "upstream" and "downstream" from one another.

The dispenser 10 comprises three main components: body member 13, having an axial bore therethrough; plug 14, mounted for rotation in the axial bore; and oil container 15, mounted on the lower or bottom side of the body member.

The axial bore of body member 13 is designated 16, and is preferably of approximately the same diameter as shower line 11. At each end of bore 16 are mounted threaded adaptors 17, 18 for connecting the body member to the shower head 12 and shower line 11, respectively. Adaptors 17, 18 may be formed integrally with body member 13 if desired. Various forms of adaptors may be employed to accomodate different shower line and shower head connection systems, and provision may be made to include washers in the bore adjacent the adaptors, or one of them, if their use is deemed appropriate.

The external shape of body member 13 is not critical, but in its preferred form it is generally cylindrical, with an oil container receiving projection 19 formed on its lower or bottom side extending at an angle of about 45° with the axis of the cylinder. In this way, assurance is obtained that oil container 15 may be held essentially upright as it is brought into contact with, and attached to, body member 13 when the latter is in its normal installed position, as shown in FIG. 1. The risk of spillage of bath oil during attachment of container 15 is thus greatly reduced.

A pair of apertures 20, 21 are formed in the bottom side wall of body member 13. Apertures 20, 21 are longitudinally spaced and are also preferably longitudinally aligned on the body member, and are in any event positioned thereon so that aperture 21 is a spaced distance upstream from aperture 20. The apertures preferably terminate at the bottom surface of projection 19, where they are encircled or encompassed by fitting means 22, which is preferably a threaded member. Like adaptors 17, 18, fitting means 22 may be made integral with body member 10, if desired.

Oil container 15 is detachably connected to body member 13, at the bottom of projection 19, by threads formed at its upper margin or rim. Preferably container 15 is formed of transparent or translucent material so that a user may observe the state of the oil supply therein.

Cylindrical plug 14 has an outside diameter substantially equal to the inside diameter of axial bore 16 of body member 10, and thus fits snugly but rotatably therein. Plug 14 has an axial venturi bore 23 extending therethrough. Although the venturi bore may be given various shapes, for convenience in construction, it is preferably symmetrical about its throat 24 in profile. Since the throat diameter of the venturi is one of the limiting factors on the flow rate of water through the device, it is desirably made as large as possible consistent with establishing the required pressure conditions for forcing bath oil into the flowing stream, as explained hereinbelow.

Figure 2:
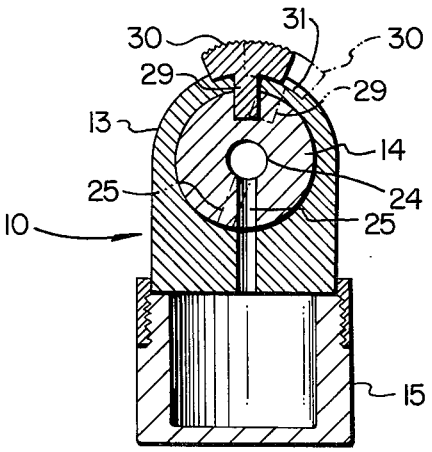
FIG. 2 is a cross-sectional end elevational view of the dispenser of FIG. 1, the section being taken on the line 2—2 of FIG. 1.
Figure 3:
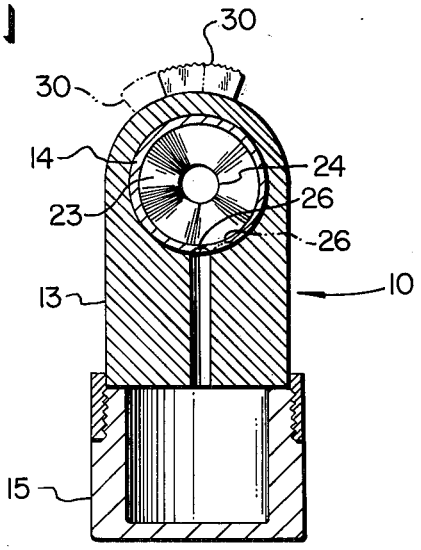
FIG. 3 is a cross-sectional end elevational view of the dispenser of FIG. 1, the section being taken on the line 3—3 of FIG. 1.
Figure 4:
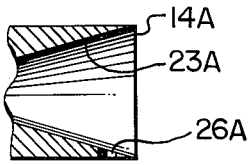
FIG. 4 is a fragmentary cross-sectional side elevational view of an alternate form of dispenser plug constructed in accordance with the invention.

Plug 14 is provided with a pair of transverse bores 25, 26 which extend from its outer surface to the venturi bore 23, and are in this sense transverse, notwithstanding that one of them, bore 26, has a pronounced longitudinal or axial component also. Bore 25 is registrable with aperture 20 and bore 26 is registrable with aperture 21 when the plug 14 is so rotated within the body member as to bring them into registration. On the other hand, the bores and apertures may be placed out of registration by a suitable rotation of the plug, as is indicated by the dashed line outlines of bores 25, 26 in FIGS. 2 and 3. It should be noted that the bores and apertures are preferably circular in cross-section and of equal diameter, for ease in construction. However, other cross-sections may be employed to give finer "tuning" of the dispensing rate upon incremental rotation of the plug.

Means are provided for rotating plug 14 to bring the bores and apertures into and out of registration to turn the dispenser on and off. These include circumferential slot 27 in body member 10, which is longitudinally aligned with bore 28 in plug 14. The shaft 29 of actuating button 30 fits through slot 27 and fits in bore 28. A shallow groove 31 is preferably formed in the surface of body member 13 to act as an alignment guide for button 30. By sliding the button 30 between the positions shown in full and dashed lines in FIGS. 2 and 3, the dispenser can be turned off and on.

In operation, water flowing through axial venturi bore 23 is at a higher pressure at the point of interception of bore 26 with the venturi bore than it is at the point of interception of bore 25 with the venturi bore. Water will accordingly flow downwardly through bore 26 and aperture 21 into container 15, where it will pick up oil. The mixture will then flow up aperture 20 and bore 25 and into the axial venturi bore at the venturi throat. The oil will be further mixed with flowing water between the venturi throat and the shower head. The action just described continues until the oil supply is exhausted, or the dispenser is turned off.

The unit may be flushed to prevent oil build-up in the apertures and bores merely by running the shower for a time with the dispenser on after the oil supply has been exhausted. In addition, the shower nozzle may be turned off and the oil container removed, in which case aperture 20 and bore 25 will be back-flushed. This action may be intensified by blocking aperture 21 with a finger.

We claim:

1. A shower head dispenser for bath oil or the like comprising:

a body member having a cylindrical bore therethrough, said body member being adapted for insertion in a shower system between a shower line and a shower head;

said body member having a pair of longitudinally spaced apertures in the side wall thereof, one of said apertures being located a spaced distance upstream of the other;

fitting means on said body member encircling said apertures;

an oil container detachably engaged with said fitting means;

a cylindrical plug rotatably mounted in the cylindrical bore of said body member;

said plug having a single axial venturi bore therethrough;

said plug being provided with a first transverse bore intercepting said axial bore at the throat of the venturi, said first transverse bore being registrable with the downstream aperture in the side wall of said body member;

said plug further being provided with a second transverse bore intercepting said axial bore upstream from the throat of the venturi, said second transverse bore being registrable with the upstream aperture in the side wall of said body member, said second transverse bore further having a longitudinal portion lying parallel to the axis of said axial venturi bore and intercepting said axial venturi bore upstream of said upstream aperture;

means for rotating said plug in said body member to bring said bores and said apertures into and out of registry, said plug rotating means comprising a slot in said body member, a button slidingly overlying said slot, said button having a shaft extending through said said slot and engaging said plug, and a guide groove in said body member slidingly engaging said button; and said body member being generally cylindrical in shape and being provided with an oil container receiving projection extending from the side thereof at an angle of about 45° to the axis of said body member.

* * * * *